United States Patent [19]

Naegeli

[11] 4,303,218

[45] Dec. 1, 1981

[54] PORTABLE FIRE EXTINGUISHER SUPPORT

[76] Inventor: Carl F. Naegeli, 5230 E. Osborn, Phoenix, Ariz. 85018

[21] Appl. No.: 161,777

[22] Filed: Jun. 23, 1980

[51] Int. Cl.[3] ..... A47G 23/02

[52] U.S. Cl. ..... 248/146; 211/72

[58] Field of Search ..... 248/146, 149, 152, 174, 248/312; 169/51; 312/290; 211/71, 72

[56] References Cited

U.S. PATENT DOCUMENTS

| | | | |
|---|---|---|---|
| 2,159,823 | 5/1939 | Snelling | 248/174 |
| 3,565,384 | 2/1971 | Lockwood | 248/312 |
| 3,734,341 | 5/1973 | Levenhagen | 211/126 X |
| 3,841,426 | 10/1974 | Nemschoff | 248/659 X |
| 4,125,084 | 11/1978 | Salmonsen | 169/51 X |

*Primary Examiner*—J. Franklin Foss

*Attorney, Agent, or Firm*—Cahill, Sutton & Thomas

[57] ABSTRACT

A portable fire extinguisher rack or support includes a rear wall section and two side wall sections adjoining the rear wall section, the rear wall section and the two side wall sections being sloped inward, the top edges of the rear and side wall sections supporting a hanger adapted to engage a support bracket of a portable fire extinguisher. A strap connected to front edges of the side walls retains the fire extinguisher so that the center of mass of the fire extinguisher is located over the geometric center of a base of the support to ensure maximum stability of the device. The front of the support is open, so that a user only needs to lift the fire extinguisher from the hanger in order to remove it from the support.

13 Claims, 13 Drawing Figures

FIG. 1
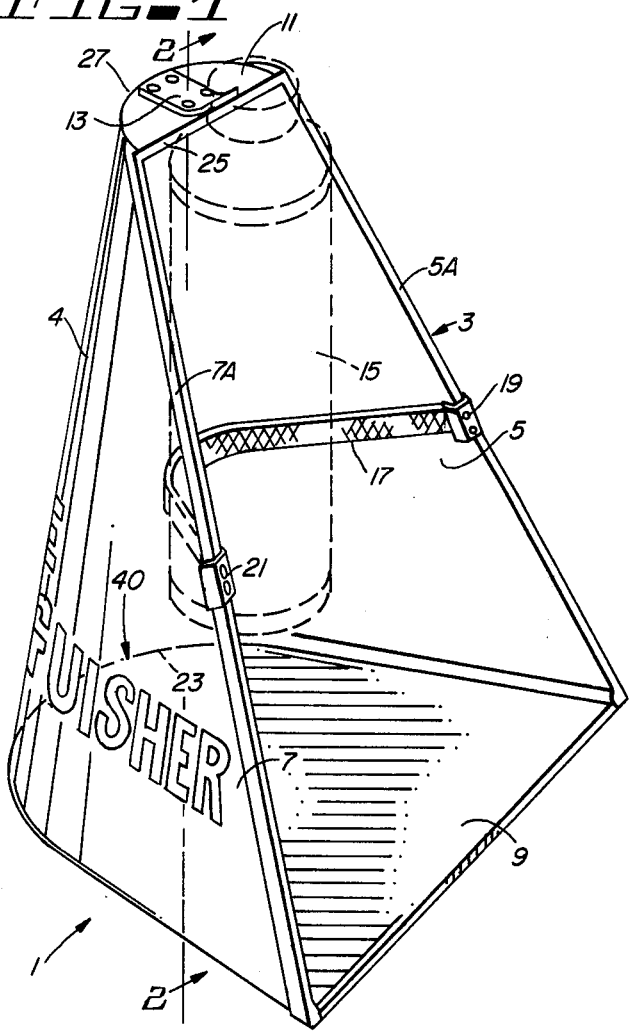
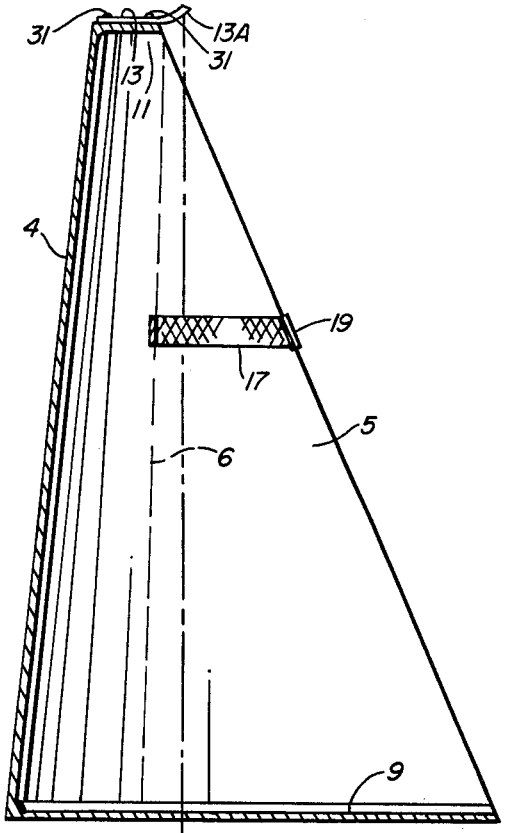
FIG. 2
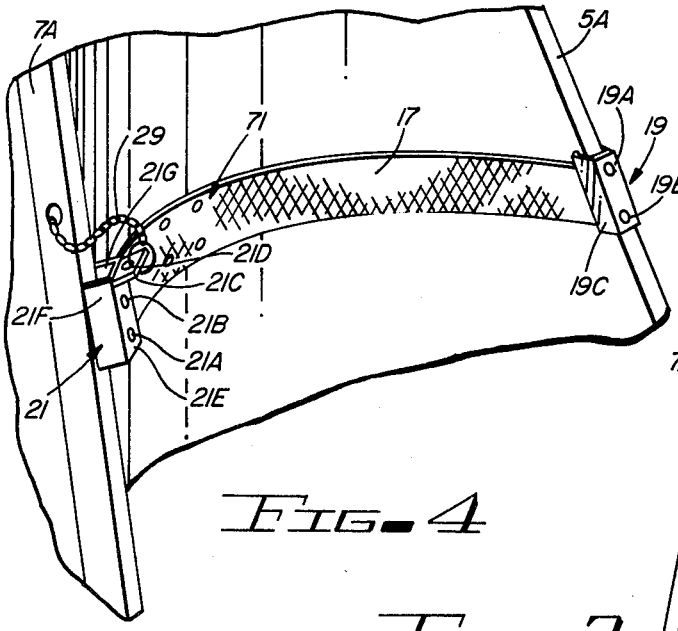
FIG. 4
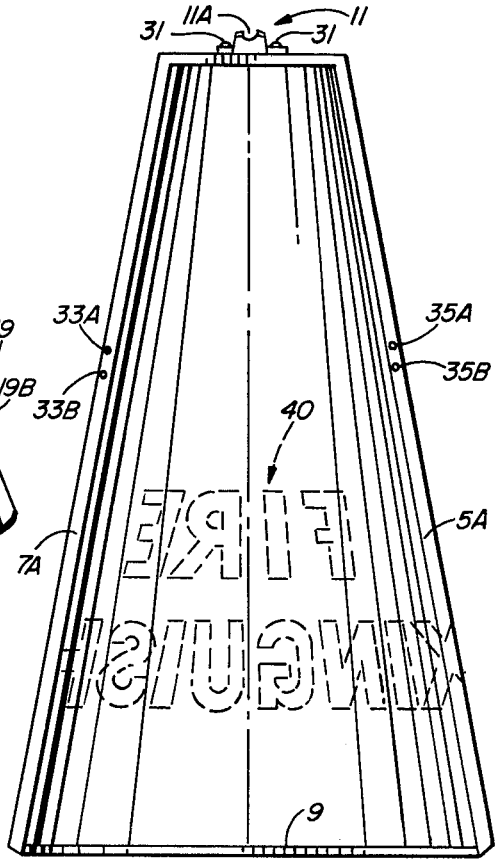
FIG. 3

PORTABLE FIRE EXTINGUISHER SUPPORT

BACKGROUND OF THE INVENTION

1. Field of the Invention

The invention relates to portable fire extinguisher supports, and more particularly, to such supports which are useful at job construction sites and which are easily and conveniently transported and stored when not in use.

2. Description of the Prior Art

Various regulations require that a minimum number of fire extinguishers be located at the site of very certain location jobs. For example, OSHA (the Occupational Safety and Health Act) regulations require that one fire extinguisher be located for every 3,000 square feet of working area throughout the life of a construction project. The OSHA regulations require that such fire extinguishers be mounted approximately 3½ feet above a ground or floor surface and that the location of each fire extinguisher be identified both by the color of the supports therefore and by means of large letters spelling the words "FIRE EXTINGUISHER." The regulations exist because fire prevention and control measures of other types frequently are not conveniently provided at such construction sites, resulting in frequent injury to workers when fires break out at construction sites. Presently, construction workers frequently build fire extinguisher support racks out of two by four" wood stud material or the like and also construct make-shift signs identifying the locations of the portable fire extinguishers out of available materials. The studs utilized are quite expensive, as are the materials utilized for the signs. Furthermore, the labor costs incurred in making the make-shift racks and signs are unduly high. The make-shift racks and signs are ordinarily simply torn apart and discarded after a construction job is completed, since the racks cannot be conveniently transported or stored. Although a prior art search directed to the present invention was performed and uncovered U.S. Pat. Nos. 1,879,937; 2,511,292; 2,615,238; 3,565,384; 3,547,309; 3,561,158; 3,602,368; and 3,921,950 disclosing a variety of racks and fire extinguisher supports, none disclose an inexpensive, safe, portable, easily transported and stored fire extinguisher support suitable for satisfying the above-mentioned regulations.

Accordingly, it is an object of the invention to provide an inexpensive support or rack for portable fire extinguishers.

It is another object of the invention to provide an inexpensive fire extinguisher support which is easily transported and is conveniently stackable with other such fire extinguisher supports.

It is another object of the invention to provide an inexpensive, stackable, fire extinguisher support which is portable and highly stable and not easily damaged or knocked over by gusts of winds or by being bumped by construction workers and their equipment.

It is another object of the invention to provide a support for portable fire extinguishers, which support is adjustable to stably and safely support a variety of sizes of portable fire extinguishers.

Typically, at construction sites, there are no permanent walls or other vertical structures to permit fastening of conventional hangers for supporting portable fire extinguishers. There is a need for a means of supporting portable fire extinguishers which enable the portable fire extinguishers to be easily relocated as the progress of job work at a construction site progresses.

It is another object of the invention to provide a low cost, durable portable fire extinguisher stand which is easily relocatable as progress of job work at a construction site progresses and which is capable of supporting various sizes and weights of portable fire extinguishers having various support brackets or hooks thereon.

SUMMARY OF THE INVENTION

Briefly described, and in accordance with one embodiment thereof, the invention provides a portable support for hand-held fire extinguishers, wherein the support includes a rear wall section, two side wall sections adjoining the rear wall section, and an open front, the rear and side wall sections sloping inwardly and supporting a hanger which engages and supports a basket or hook attached to the fire extinguisher adjacent to its neck. A means is provided for maintaining the body of the fire extinguisher so that its center of mass is retained approximately over the geometrical center of an area subtended to the bottom edges of the rear and side wall sections. The side wall sections flare outward toward the open front to facilitate stacking of a plurality of such supports by nesting each within the interior of the other through the open front thereof. In the described embodiment of the invention, the rear wall section is of a semi-frusto-conical configuration, and the side wall portions are substantially triangular and are integral with the rear wall section. A base or floor subtended by the lower edges of the rear and side walls is integral therewith, and a top plate is integral with and supported by the top edge of the semi-frusto-conical rear wall section. The top plate, base, rear and side wall sections are all molded of suitable plastic, such as polyvinyl chloride or polyethylene. In the described embodiment of the invention, the means for retaining the body of the supported fire extinguisher so that its center of mass lies over the geometrical center of the base includes an adjustable strap having its ends securely fastened to the respective two front edges of the side wall sections. The strap loops around the body of the fire extinguisher. A first end of the strap is fastened by means of a fixed clamp to a first front edge of the support, the second end of the strap having a plurality of holes therein. A pair of pegs for extending through a selected pair of the holes is rigidly attached to the second front edge of the support. A removable clamp retains the second end of the strap in the fastened relationship with the two pegs. A hanger is attached to the top plate for receiving a support bracket or hook of the portable fire extinguisher to be supported by the rack.

BRIEF DESCRIPTION OF THE DRAWINGS

FIG. 1 is a perspective view of the portable fire extinguisher rack of the present invention.

FIG. 2 is a section view taken along section line 2—2 of FIG. 1.

FIG. 3 is a front view of the portable fire extinguisher rack of FIG. 1.

FIG. 4 is an enlarged partial perspective view of the portable fire extinguisher rack of FIG. 1.

DESCRIPTION OF THE INVENTION

Figure 5:
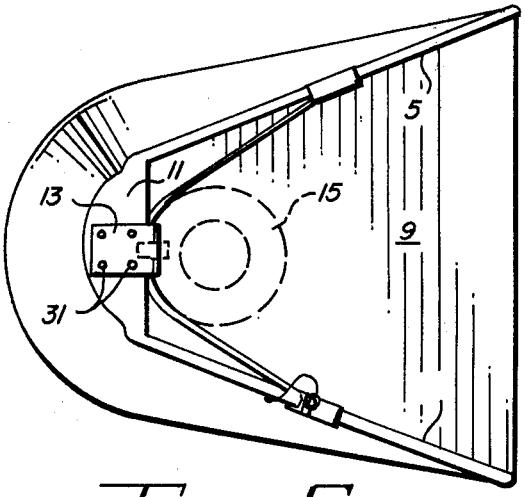
FIG. 5 is a top view of the portable fire extinguisher rack of FIG. 1.

Referring now to the drawings, portable rack or support 1 includes a floor 9 and a continuous wall 3. Wall 3 includes a semi-frusto-conical rear section 4 and a pair of side sections 5 and 7, each having the configuration of a right triangle. Side wall sections 5 and 7 are integral with rear wall section 4. Dotted line 6 in FIG. 2 designates an imaginary boundary between the right triangle configurations of side wall sections 5 and rear wall section 4. Floor 9 is attached to the lower edge of wall 3 and, in the preferred embodiment of the invention, is integral with wall 3.

Top plate 11 is attached to the top edge of rear wall section 4, and forms the top of the semi-frusto-conical rear wall section. In the preferred embodiment of the invention, the above-described wall, floor, and top plate structures are integral and are formed of polyethylene, polyvinyl chloride, or other suitable plastic. As best shown in FIGS. 1 and 4, sloping front edges 5A and 7A of side wall sections 5 and 7, respectively, are of increased thickness to provide additional structural support strength of rack 1.

A "hanger" 13 is attached by means of bolts 31 (FIG. 2) to the top upper surface of plate 11, as seen in FIGS. 1, 3, 5 and 6. The front edge of hanger 13 extends beyond the front edge of plate 11 and is adapted to support certain types of fire extinguisher brackets attached to fire extinguisher 15 adjacent to its neck. A variety of different types of neck mounted support hooks and brackets are attached to various types of commercially available hand-held fire extinguishers, and reference numeral 13 is utilized to indicate a variety of different types of hangers in FIGS. 7, 8, and 11–13, for engaging and supporting several different types of known neck-mounted fire extinguisher support brackets.

Referring to FIG. 1, a typical portable fire extinguisher 15 is indicated by dotted lines. In order to ensure that rack 1 is highly stable as it supports a heavy fire extinguisher by means of hanger 13, it is necessary to ensure that the center of mass of fire extinguisher 15 is located approximately over the geometric center of floor 9. Strap 17 is utilized to accomplish this function. (Note that it would be possible also to attach various other retaining members to the interior walls of rack 1 to prevent the lower portion of fire extinguisher 15 from tilting toward the rear of rack 1, thereby shifting its center of mass toward the rear of rack 1, making rack 1 unstable).

Figure 10:
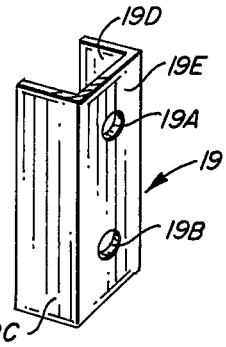
FIG. 10 is a perspective view of a fixed clamp for attaching one end of the retaining strap shown in FIG. 1.
Figure 11:
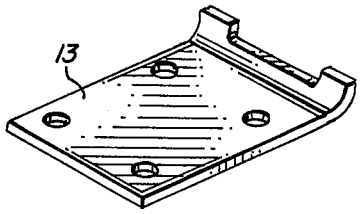
FIG. 11 is a perspective view of an alternate hanger which can be utilized on the rack of FIG. 1.
Figure 6:
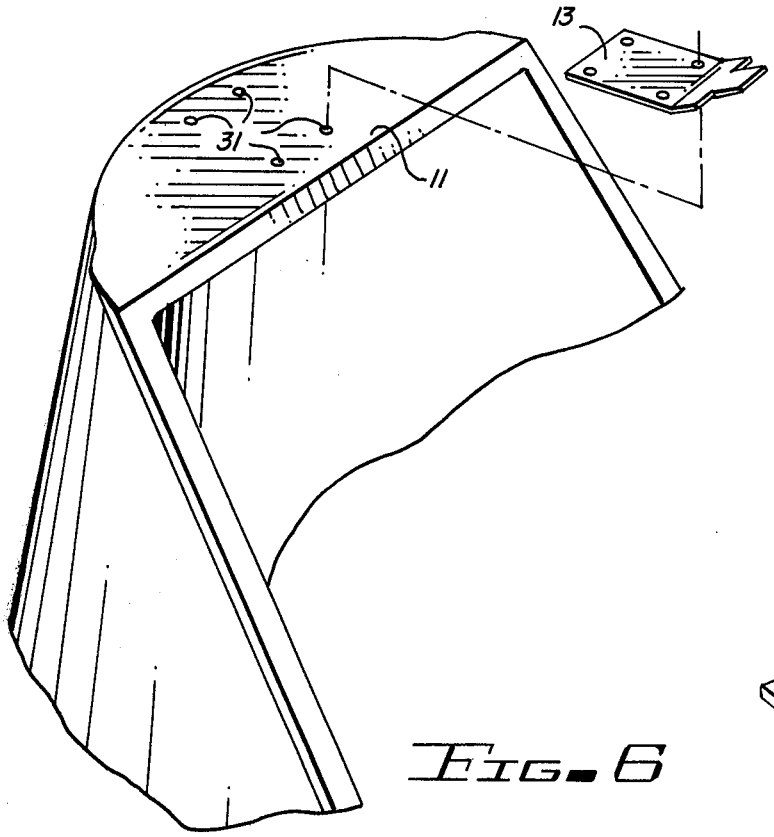
FIG. 6 is a partial perspective exploded view illustrating the top plate and hanger of the portable fire extinguisher rack of FIG. 1.
Figure 12:
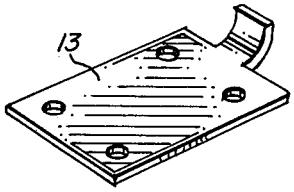
FIG. 12 is yet another hanger which can be utilized on the rack of FIG. 1.
Figure 13:
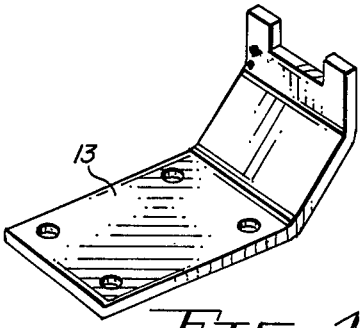
FIG. 13 is still another hanger which can be utilized on the rack of FIG. 1.
Figure 7:
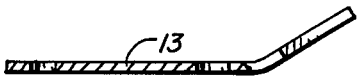
FIG. 7 is a side view of the hanger shown in FIG. 6.
Figure 8:
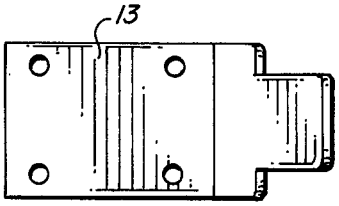
FIG. 8 is a top view of the hanger shown in FIG. 7.

Retaining strap 17 has its right end permanently attached to the front edge 5A of side wall section 5 by means of fixed clamp 19. As best shown in FIGS. 4 and 10, fixed clamp 10 consists of a U-shaped structure having sides 19C and 19D and a top plate 19E. Top plate 19E has holes 19A and 19B therein. A pair of screws 19A' and 19B' (FIG. 4) extend through a pair of holes (not shown) at the right end of retaining strap 3, securely fastening the right end of retaining strap 17 to edge 5A.

The left end of retaining strap 17 has a plurality of spaced holes 71 punched therein. Two pegs 33A and 33B (FIG. 3) are rigidly attached to left front edge 7A. Pegs 33A and 33B extend through a selected pair of the holes 71 in retaining strap 17, thereby preventing it from moving laterally. Removable clamp 21, shown in FIGS. 4 and 9, is then placed over the left end of retaining belt 17, so that the outer ends of pegs 33A and 33B extend through holes 21A and 21B in top plate 21E of removable clamp 21.

A pair of relatively narrow elongated slots 21A' and 21B' extend from holes 21A and 21B, respectively, and engage a pair of mating notches (not shown) in the ends of pegs 33B and 33A, respectively, allowing clamp 21 to be securely but removably fastened to retain the left end of retaining belt 17 so that pegs 33A and 33B remain extended through the above-mentioned selected pair of holes 71.

Figure 9:
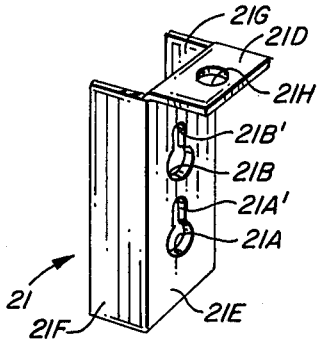
FIG. 9 is a perspective view of the removable clamp used to adjustably attach one end of the retaining strap shown in FIG. 1.

As best seen in FIG. 9, removable bracket 21 includes two sides 21F and 21G and a tab 21D having a hole 21H therein. A chain 29 (FIG. 4) having one end looped through hole 21H and the other end affixed to edge 7A prevents removable bracket 21 from being lost when it is temporarily disengaged from pegs 33A and 33B.

Holes 35A and 35B (FIG. 3) receive screws 19A and 19B (FIG. 4) to effect attachment of fixed clamp 19 to right front edge 5A.

As indicated in FIG. 1, the words "FIRE EXTINGUISHER" are embossed on, embedded in, or otherwise affixed to the sides of rack 1.

While the invention has been described with reference to a particular embodiment thereof, those skilled in the art will be able to make various modifications to the disclosed structure without departing from the true spirit and scope of the invention, as set forth in the appended claims. For example, it is not necessary that floor 9 be solid, as the main function of floor 9 is to provide reinforcement to prevent lateral movement of side walls 5 and 7. Reinforcing members could be provided along the bottom of rack 1 in place of floor 9 to achieve the same result. Removable foot pads or legs could be attached to the bottom of rack 1 to allow rack 1 to more stably rest on uneven or rocky ground. In order to enhance the "stackability" of rack 1 with other such racks, the upper and lower portions of the rack could be separately molded, and could be designed to fit together in a telescoping fashion.

In the presently preferred embodiment of the invention, the unitary structure including floor 9, top plate 11 and continuous wall 3 is molded as an integral plastic device. The wall thickness for a polyethylene device can be approximately one-eighth of an inch in thickness, the thickness of floor 9 can be approximately one-half inch, the thickness of top plate 11 can be approximately three-fourths of an inch, and the front edge sections 5A and 7A can have cross-sections which are approximately three-fourths of an inch square. The overall height of the rack 1 is approximately 42 inches in one presently preferred embodiment of the invention.

I claim:

1. A rack for supporting a portable fire extinguisher having a support element attached thereto, said support element being disposed approximately at the level of a neck of said portable fire extinguisher, said rack comprising in combination:

(a) hanger means for engaging said support element in order to allow hanging of said portable fire extinguisher from said hanger means;

(b) hanger support means for supporting said hanger means;

(c) wall means for bounding an interior region and supporting said hanger support means whereby the body of said portable fire extinguisher hangs into said interior region, said wall means having an open front exposing said interior region and said portable fire extinguisher hanging therein so that said portable fire extinguisher can be easily grasped and lifted out of said interior region, said wall means having an upper edge and a lower edge, said hanger support means being supported at said upper edge by said wall means; and (d) retaining means disposed in said interior region for retaining the body of said hanging portable fire extinguisher in a position such that the center of mass of said fire extinguisher is positioned approximately directly over the geometrical center of an area subtended by said wall means, wherein said retaining means includes a retaining strap having a first end affixed to a first front edge of said wall means and a second end attached to a second front edge of said wall means, said retaining means passing behind said hanging fire extinguisher to maintain it in a position such that its center of mass is approximately directly over the geometrical center of the area subtended by said wall means whereby maximum stability of said portable rack and said fire extinguisher supported thereby is achieved.

2. The rack of claim 1 further including bottom means attached to said lower edge for supporting said wall means and reinforcing said wall means to prevent lateral movement of one portion thereof relative to another portion thereof.

3. The rack of claim 2 wherein said hanger support means, said wall means, and said bottom means are included in an integral unit.

4. The rack of claim 3 wherein said integral unit is composed of plastic.

5. The rack of claim 4 wherein said plastic is polyethylene.

6. The rack of claim 4 wherein said plastic is polyvinyl chloride.

7. The rack of claim 3 wherein said wall means includes a rear wall section and first and second side wall sections.

8. The rack of claim 7 wherein said rear wall section and said side wall sections slope inwardly from said lower edge.

9. The rack of claim 8 wherein said hanger support means is attached to, supported by, and integral with the upper edge of said wall means.

10. The rack of claim 9 wherein said rear wall section includes a semi-frusto-conical wall section and said side wall sections each have a right triangle configuration, said rear wall section and said side wall sections being continuous.

11. The rack of claim 10 wherein said first and second side wall sections flare outwardly toward said open front, whereby a plurality of said portable racks can be conveniently stacked together by nesting the rear portion of one portable rack through the open front into the interior region of another portable rack.

12. The rack of claim 1 wherein said second end of said retaining strap is adjustably affixed to said second front edge to allow adjustment of the position of said hanging fire extinguisher.

13. A rack for supporting a portable fire extinguisher having a support element attached thereto, said support element being disposed approximately at the level of a neck of said portable fire extinguisher, said rack comprising in combination:

(a) hanger means for engaging said support element in order to allow hanging of said portable fire extinguisher from said hanger means;

(b) hanger support means for supporting said hanger means;

(c) wall means for bounding an interior region and supporting said hanger support means whereby the body of said portable fire extinguisher hangs into said interior region, said wall means having an open front exposing said interior region and said portable fire extinguisher hanging therein so that said portable fire extinguisher can be easily grasped and lifted out of said interior region, said wall means having an upper edge and a lower edge, said hanger support means being supported at said upper edge by said wall means; and (d) retaining means extending between and attached to said interior region by opposed portions of said wall means for passing behind the body of said hanging portable fire extinguisher in a position such that the center of mass of said fire extinguisher is retained in a position approximately directly over the geometrical center of an area subtended by said wall means, whereby maximum stability of said portable rack and said fire extinguisher supported thereby is achieved.

* * * * *